United States Patent [19]

Nakagawa

[11] 4,397,454

[45] Aug. 9, 1983

[54] DEVICE FOR HOLDING A SLIDER FOR A SLIDE FASTENER

[75] Inventor: Toshiaki Nakagawa, Kurobe, Japan

[73] Assignee: Yoshida Kogyo K. K., Tokyo, Japan

[21] Appl. No.: 366,360

[22] Filed: Apr. 7, 1982

[30] Foreign Application Priority Data

Apr. 11, 1981 [JP] Japan ..... 56-51454[U]

[51] Int. Cl.[3] ..... B23P 19/04

[52] U.S. Cl. ..... 269/49; 269/909; 29/768

[58] Field of Search ..... 269/49, 909, 237; 29/766–770

[56] References Cited

U.S. PATENT DOCUMENTS

| | | | |
|---|---|---|---|
| 3,685,814 | 4/1972 | Kawasaki | 269/49 |
| 3,812,571 | 5/1974 | Dori | 269/909 |
| 3,844,014 | 10/1974 | Takahashi et al. | 29/768 |
| 3,902,235 | 9/1975 | Kawakami et al. | 269/49 |
| 3,945,103 | 3/1976 | Fujisaki et al. | 29/768 |

*Primary Examiner*—Robert C. Watson

*Attorney, Agent, or Firm*—Hill, Van Santen, Steadman, Chiara & Simpson

[57] ABSTRACT

A device for holding a slider in position during threading onto a slide fastener chain includes a housing having a support surface for supporting thereon a slider body upside down, and a slit receptive of a pull tab hanging from the slider body. A lever has a pair of juxtaposed first and second arms disposed one on each side of the slit, there being on the first arm a locking projection movable into and out of the slit. The lever is pivotable in the housing between a slider-holding position and a slider-release position. The second arm extends beyond the first arm to such an extent that as the slider is placed on the support surface, the second arm is pressed downwardly by a yoke of the slider to cause the lever to be pivotally moved to the slider-holding position. When a reverse or upward pull is exerted on the slider during the threading of the fastener chain through the slider, the second arm is brought into contact with the slider body, thus preventing the lever from being pivotally moved to the slider-release position.

3 Claims, 7 Drawing Figures

DEVICE FOR HOLDING A SLIDER FOR A SLIDE FASTENER

BACKGROUND OF THE INVENTION

1. Field of the Invention

The present invention relates to the production of slide fasteners, and more particularly to a device for holding a slider in position during threading or mounting onto a slide fastener chain.

2. Prior Art

In the manufacture of a slide fastener, a slider is held in position by a device while a pair of fastener stringers, each stringer having a row of coupling elements mounted on a stringer tape, is threaded through a Y-shaped channel in the slider; the coupling elements on one tape are interengaged with the coupling elements on the other tape as they pass through the slider.

A known slider holding device, as disclosed in U.S. Pat. No. 3,685,814 issued Aug. 22, 1972, includes a housing having a support surface for supporting thereon a slider body upside down, a slit receptive of a pull tab hanging from the slider body, and a lever pivotally mounted in the housing and having an upper and a lower projection. The lever is pivotable between a slider-holding position in which the upper projection projects into the slit for engagement with an opening in the pull tab, and a slider-release position in which the upper projection is retracted out of the slit for releasing the pull tab and for allowing the pull tab to be inserted into the slit. The lever is urged to either the slider-holding position or the slider-release position in a known manner. The lower projection extends across the slit for being pressed downwardly by the free end of the pull tab when the latter is inserted into the slit. This downward pressing causes the lever to be pivotally moved to the slider-holding position. The prior art device requires a plurality of levers of different length for respectively holding pull tabs of different lengths. Thus a suitable one of the levers must be chosen depending on the length of the pull tab, which is laborious and time-consuming. Otherwise the prior device cannot be used for various kinds of sliders having pull tabs of different length.

SUMMARY OF THE INVENTION

According to the present invention, a device for holding a slider in position for threading onto a slide fastener chain includes a housing having a support surface for supporting thereon a slider body upside down, and a slit receptive of a pull tab hanging from the slider body. A lever has a pair of juxtaposed first and second arms disposed one on each side of the slit, there being on the first arm a locking projection movable into and out of the slit. The lever is pivotable in the housing between a slider-holding position and a slider-release position. The second arm extends beyond the first arm to such an extent that as the slider is placed on the support surface, the second arm is pressed downwardly by a yoke of the slider to cause the lever to be pivotally moved to the slider-holding position. when a reverse or upward pull is exerted on the slider during the threading of the fastener chain through the slider, the second arm is brought into contact with the slider body, thus preventing the lever from being pivotally moved to the slider-release position.

It is therefore an object of the invention to provide a slider holder suitable to be used for with various kinds of sliders having pull tabs of different length.

Another object of the invention is to provide a slider holder with which a slider is held in position without being removed during the movement of a slide fastener in either direction through the slider.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
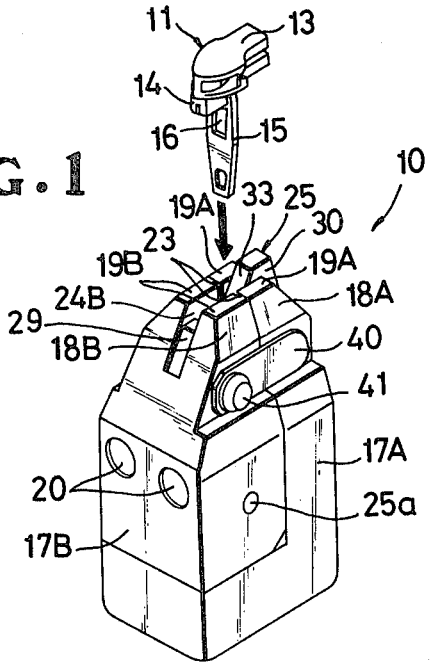
FIG. 1 is a perspective view of a slider holder according to the present invention, and a slider to be placed on the slider holder.
Figure 2:
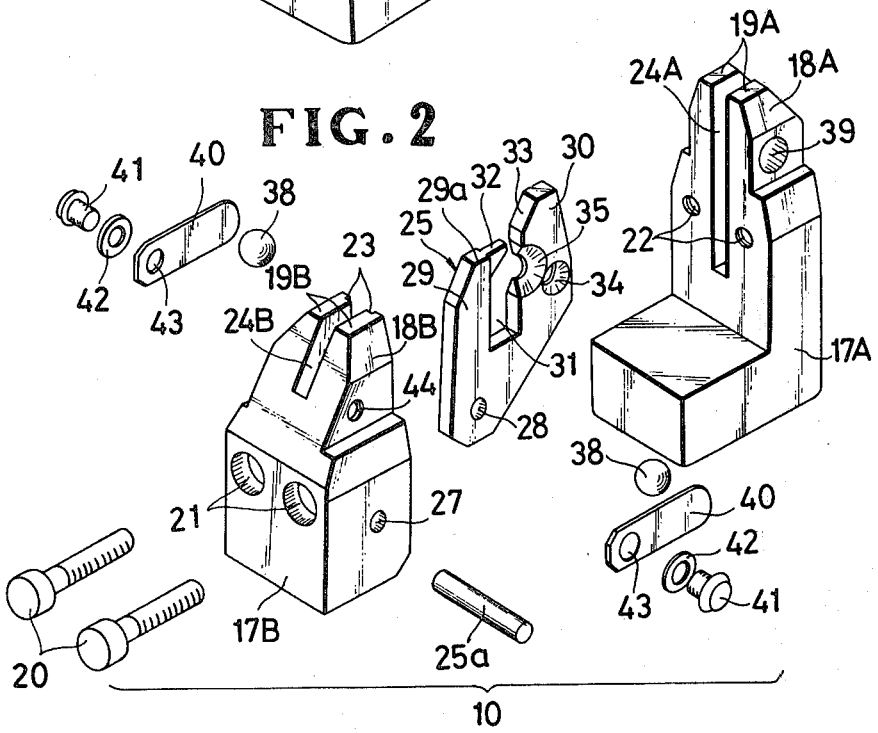
FIG. 2 is an exploded perspective view of the slider holder of FIG. 1.
Figure 7:
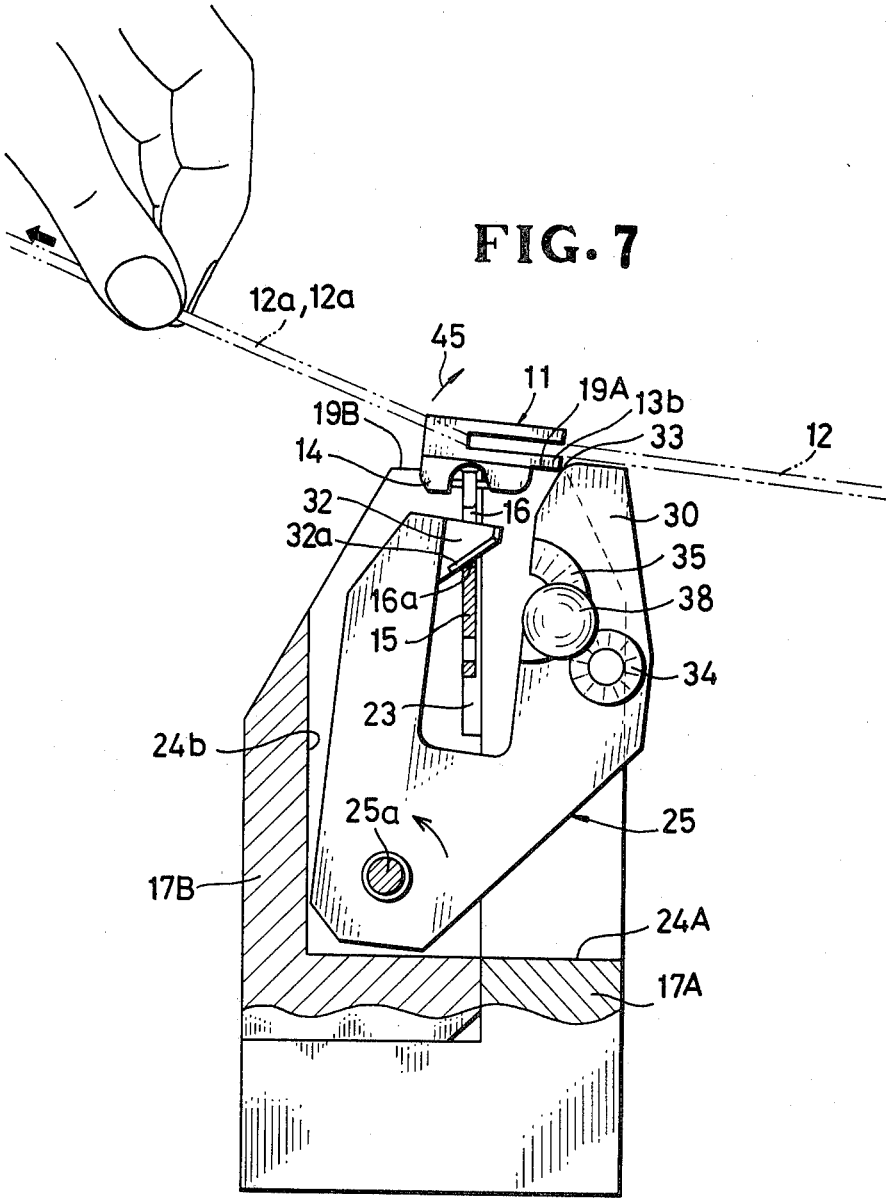
FIG. 7 is a view similar to FIG. 5, but illustrating the manner in which the slider is prevented from being removed from the slider holder while the slider is threaded onto a slide fastener chain.

FIGS. 1 and 2 show a slider holder 10 for holding or retaining a slider 11 in position for threading or mounting onto a slide fastener chain 12 (FIG. 7). The slider 11 includes a slider body 13, a yoke or cover 14 mounted on the slider body 13, and a pull tab 15 pivotally connected to the yoke 14 and having an opening 16 adjacent to the yoke 14.

The slider holder 10 includes a combined housing composed of a pair of first and second housing parts 17A,17B complementary in shape with one another and having a combined slider test 18A,18B on which the slider 11 is to be placed upside down. The first and second housing parts 17A,17B are connected together by means of a pair of screws 20,20 extending through a pair of holes 21,21 respectively, in the second housing part 17B into a pair of threaded holes 22,22, respectively, in the first housing part 17A. The slider rest 18A,18B has a combined horizontal support surface 19A,19B for supporting thereon the slider body 13.

The housing 17A,17B has a vertical slit 23 opening into the support surface 19A,19B for loosely receiving the pull tab 15 hanging from the slider body 13 supported on the support surface 19A,19B, and the housing further has a combined cavity 24A,24B communicating with the slit 23 and opening into the support surface 19A,19B. The slit 23 includes a groove formed in the second housing part 17B. Alternatively, the groove may be formed in the first housing part 17A or may be composed of a pair of vertical groove halves formed one in each of the first and second housing parts 17A,17B.

Figure 3:
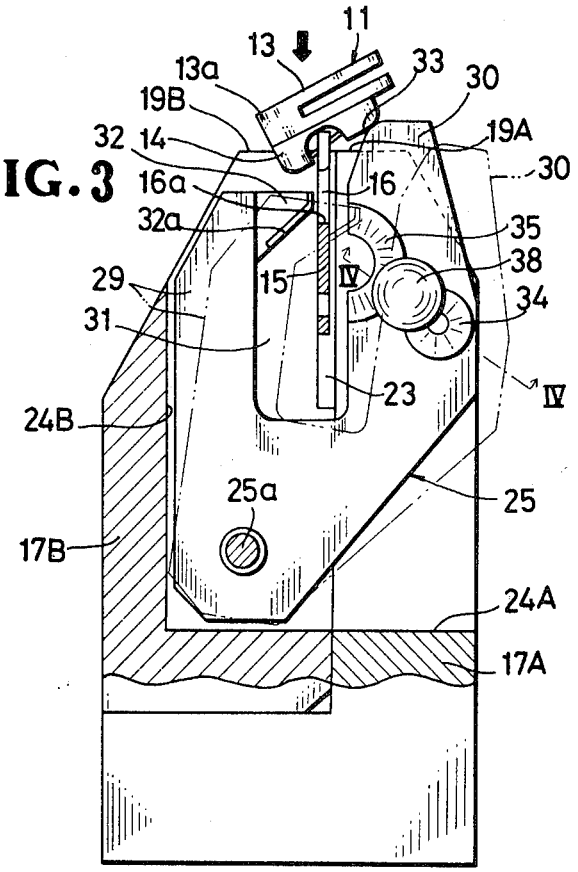
FIG. 3 is an enlarged side elevational view, partly in cross section, of the slide holder, illustrating the manner in which the slider is first supported by the slider holder.

A lever 25 is pivotally mounted in the housing 17A,17B by means of a pin 25*a* extending through a hole 27 in the second housing part 17B and also through a hole 28 in the lever 25. The lever 25 is generally U-shaped and hence has a pair of juxtaposed first and second arms 29,30 disposed one on each side of the slit 23, there being a cutout 31 between the first and second arms 29,30. The first arm 29 has an inwardly directed locking projection 32 on its upper end 29*a*, the locking projection 32 thus extending toward and terminating short of the second arm 30. The lever 25 is pivotable between a slider-holding position (FIG. 5) in which the locking projection 32 projects into the slit 23 for reception into the opening 16 of the slider pull tab 15, and a slider-release position (not shown, but the solid line position in FIG. 3 is virtually the same as this position) in which the locking projection 32 is retracted out of the slit 23 for releasing the pull tab 15.

The second arm 30 of the lever 25 extends beyond the first arm 29 to such an extent that as the slider 11 is placed on the support surface 19A,19B, the second arm 30 is pressed downwardly by the yoke 14 of the slider 11 to cause the lever to be pivotally moved from the slider-release position to the slider-holding position, as described below. The second arm 30 has an outwardly inclined contact surface 33 which is engageable with the yoke 14 when the yoke 14 is pressed against the second arm 30. The contact surface 33 also serves to prevent the lever 25 from being pivotally moved to the slider-release position even when a reverse or upward pulling force is exerted on the slider 11 during use of the device.

The locking projection 32 has an inclined contact surface 32*a* extending along a lower side edge thereof for engagement with an opening-defining edge 16*a* (FIGS. 3, 5 and 7) of the pull tab 15 when the lever 25 is in the slider-holding position and also when the pull tab 15 is pulled upwardly in the slit 23. When the slider 11 is removed from the slider holder 10, the pull tab 15 is pulled upwardly to act against the contact surface 32*a*, and therefore it pushes the locking projection 32 out of the slit 23 as the lever 25 is pivotally moved to the slider-release position. During such removal, the slider 11 is pulled upwardly with the slider body 13 first tilted so as to be kept off the contact surface 33 of the second arm 30, thus allowing the lever 25 to be pivotally moved to the slider-release position.

Figure 4:
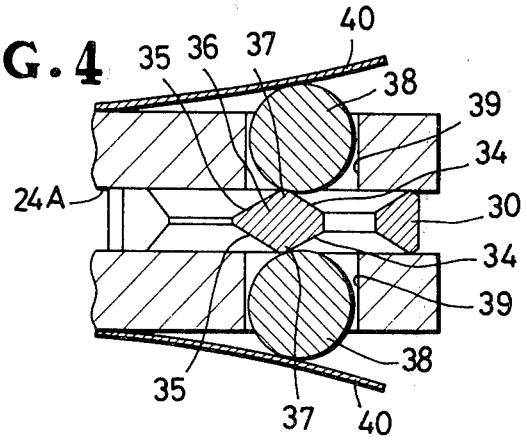
FIG. 4 is an enlarged cross-sectional view taken along line IV—IV of FIG. 3.

The lever 25 is urged to either the slider-holding position or the slider-release position by the following detent structure. The second arm 30 has at its midportion two pairs of recesses 34,35 and 34,35 disposed one pair on each side. The recesses 34,35 of each pair are disposed close to one another; the small recess 34 has a frustoconical surface, and the large recess 35 has a half-frustoconical surface. Thus the second arm 30 has a neck portion 36 of generally rhombic cross section (FIGS. 4 and 6) having a pair of ridges 37,37 (FIGS. 4 and 5) on opposite sides. A pair of balls 38,38 preferably made of steel is received in a pair of holes 39,39, respectively, in the first housing part 17A and is urged against the ridges 37,37, respectively, of the rhombic neck portion 36 by a pair of leaf springs 40,40. Each leaf spring 40 is secured to the second housing part 17B by a screw 41 extending through a washer 42 and an opening 43 of the leaf spring 40 into a threaded hole 44 in the second housing part 17B, as shown in FIGS. 1 and 2. Thus, each ball 38, in response to the pivotal movement of the lever 25, is receivable in the large or the small recesses 35,34, at which time the ridges 37 pass between the balls 38.

In order to make the slider holder 10 suitable to be used for a variety of sliders 11 (only one illustrated) having pull tabs 15 of different length, the slit 23 has a length longer than that of the longest one of the different pull tabs, the cutout 31 of the lever 25 extending downwardly beyond the slit 23.

In operation, the slider 11 is placed upside down on the slider rest 18A,18B with the pull tab 15 inserted into the slit 23, the lever 25 being held in the slider-release position. In the slider-release position, the locking projection 32 on the first arm 29 is retracted from the slit 23, the second arm 30 projects beyond the support surface 19A,19B, and each ball 38 is disposed in the small recess 34. The yoke 14 of the slider 11 is then pressed against the contact surface 33 as shown in FIG. 3. The second arm 30 is thereby pushed downwardly to cause the lever 25 to be pivotally moved clockwise in FIG. 3 until each ball 38 rides over the ridge 37 into the large recess 35. As a result, the lever 25 has come to the slider-holding position (FIG. 5) in which the locking projection 32 projects into the slit 23 to enter the opening 16 of the pull tab 15.

Figure 5:
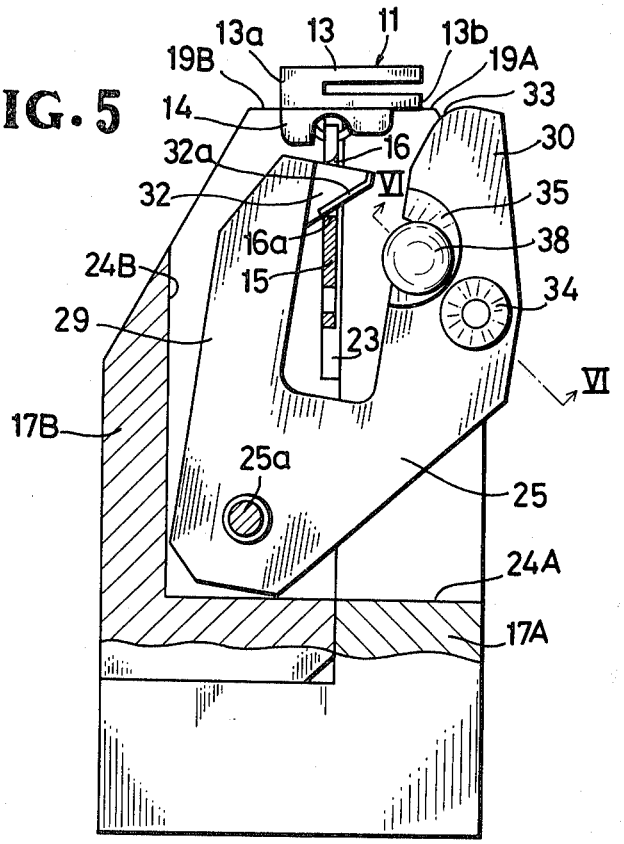
FIG. 5 is a view similar to FIG. 3, but showing the slider holder in a slider-holding position.
Figure 6:
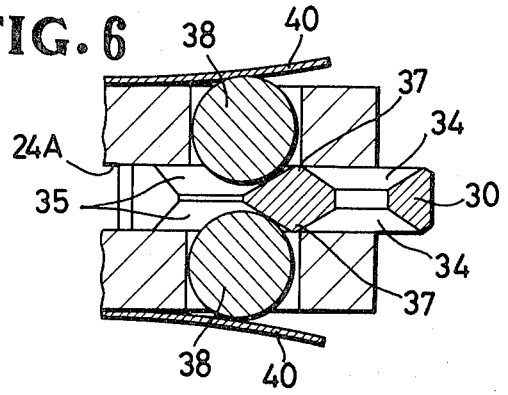
FIG. 6 is an enlarged cross-sectional view taken along line VI—VI of FIG. 5.

With the slider 11 thus held on the slider rest 18A,18A, a slide fastener chain 12 (phantom lines in FIG. 7) is threaded through the slider body 13. More specifically, a pair of disengaged fastener stringers 12*a*,12*a* of the fastener chain 12 is threaded through the slider body 13 from its flared or front end 13*a* (FIGS. 3, and 5). As the fastener chain 12 is moved rightwardly in FIG. 7, the pair of disengaged fastener stringers 12*a*,12*a* is progressively interengaged. If misinterengagement of the fastener stringers has occurred, the fastener chain 12 is pulled back leftwardly or moved reversely as shown in FIG. 7, at which time a pull is necessarily exterted on the slider body 13 as indicated by an arrow 45. The pull tab 15 is thus pulled upwardly to cause the lever 25 to be pivotally urged counterclockwise. The contact surface 33 of the second arm 30 is brought into contact with the slider body 13 on its rear end 13*b*, and further pivotal movement of the lever 25 in the counterclockwise direction is thereby prevented.

For removal from the slider holder 10, the slider 11 is pulled upwardly with the slider body 13 first tilted leftwardly so as to be kept off the contact surface 33 of the second arm 30, thus allowing the lever 25 to be pivotally moved to the slider-release position as the locking projection 32 is pushed by the pull tab 15 out of the slit 23 to release the pull tab 15.

Since the pivotal movement of the lever 25 from the slider-release position to the slider-holding position is caused by the slider body 13 rather than the pull tab 15, the slider holder 10 is suitable to be used for various kinds sliders having pull tabs of different length. Further, with this arrangement, it is possible to hold or retain a slider in a position reliably in a single simple snap action.

In the illustrated embodiment, the second arm 30 of the lever 25 projects beyond the support surface 19A,19B as the lever 25 is in the slider-release position. However, if a slider (not shown) in which a yoke coextends with a slider body is to be held by the slider holder 10, the top of the second arm 30 may be disposed below or in the same plane as the support surface 19A,19B, when the lever 25 is in the slider-release position.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A device for holding a slider in position for threading onto a slide fastener chain, the slider including a slider body, a yoke mounted on the slider body, and a pull tab pivotally connected to the yoke and having an opening, said device comprising:

(a) a housing having a horizontal support surface for supporting thereon the slider body upside down, and a vertical slit opening into said support surface for receiving the pull tab hanging from the slider body supported on said support surface;

(b) a lever pivotally mounted in said housing and having a pair of juxtaposed arms disposed one on each side of said slit, one of said arms having a locking projection extending toward and terminating short of the other arm, said lever being pivotable between a slider-holding position in which said locking projection projects into said slit for engagement with an edge of the opening of the pull tab, and a slider-release position in which said locking projection is retracted out of said slit for releasing the pull tab, said other arm extending beyond said one arm to such an extent that as the slider is placed on said support surface, said other arm is pressed downwardly by the yoke of the slider to cause said lever to be pivotally moved from said slider-release position to said slider-holding position; and (c) means urging said lever to either said slider-holding position or said slider-release position.

2. A device according to claim 1, said other arm, as said lever is in said slider-release position, projecting beyond said support surface.

3. A device according to claim 1, said other arm having an outwardly inclined surface engageable with the yoke of the slider when the latter is placed on said support surface.

* * * * *